United States Patent [19]

Bidwell

[11] 4,224,126

[45] Sep. 23, 1980

[54] ANODE ASSEMBLY FOR HOT WATER HEATERS

[76] Inventor: Arthur W. Bidwell, 211 Highland St., Middletown, Ohio 45052

[21] Appl. No.: 29,385

[22] Filed: Apr. 12, 1979

[51] Int. Cl.[3] ..... C23F 13/00

[52] U.S. Cl. ..... 204/197; 204/286

[58] Field of Search ..... 204/197, 286; 174/84 S

[56] References Cited

U.S. PATENT DOCUMENTS

| | | | |
|---|---|---|---|
| 629,092 | 7/1899 | Ross | 204/197 |
| 3,558,463 | 1/1971 | Strobach et al. | 204/197 |
| 3,891,530 | 6/1975 | Alewitz | 204/197 |
| 4,035,903 | 7/1977 | Taggart | 204/197 X |
| 4,093,529 | 6/1978 | Strobach | 204/197 |

FOREIGN PATENT DOCUMENTS

| | | | |
|---|---|---|---|
| 494807 | 7/1953 | Canada | 204/197 |
| 2449022 | 4/1976 | Fed. Rep. of Germany | 204/197 |

*Primary Examiner*—G. L. Kaplan

*Attorney, Agent, or Firm*—Shlesinger, Arkwright, Garvey and Dinsmore

[57] ABSTRACT

A plug-type anode assembly includes a configured anode end for ease of assembly and improved core wire contact, a heat shrinkable sealing sleeve, and a sealant for completely filling the interstices between the plug and anode.

17 Claims, 6 Drawing Figures

FIG.1
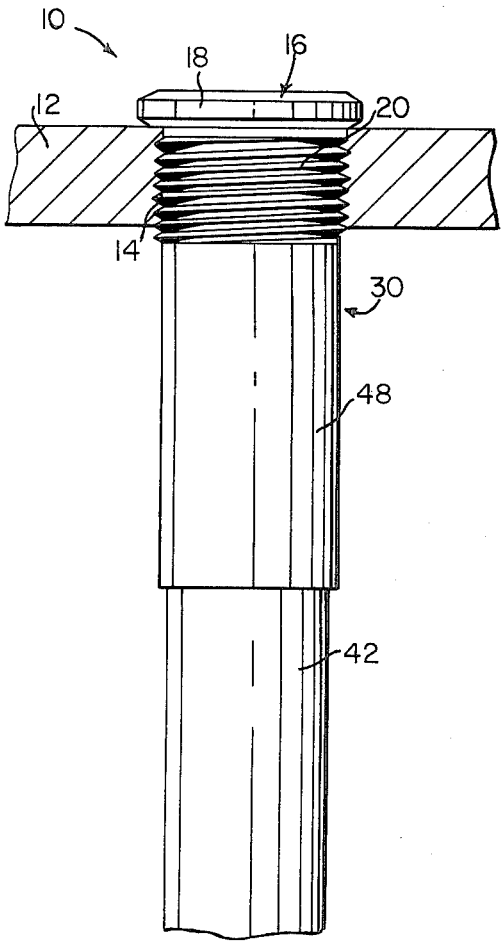
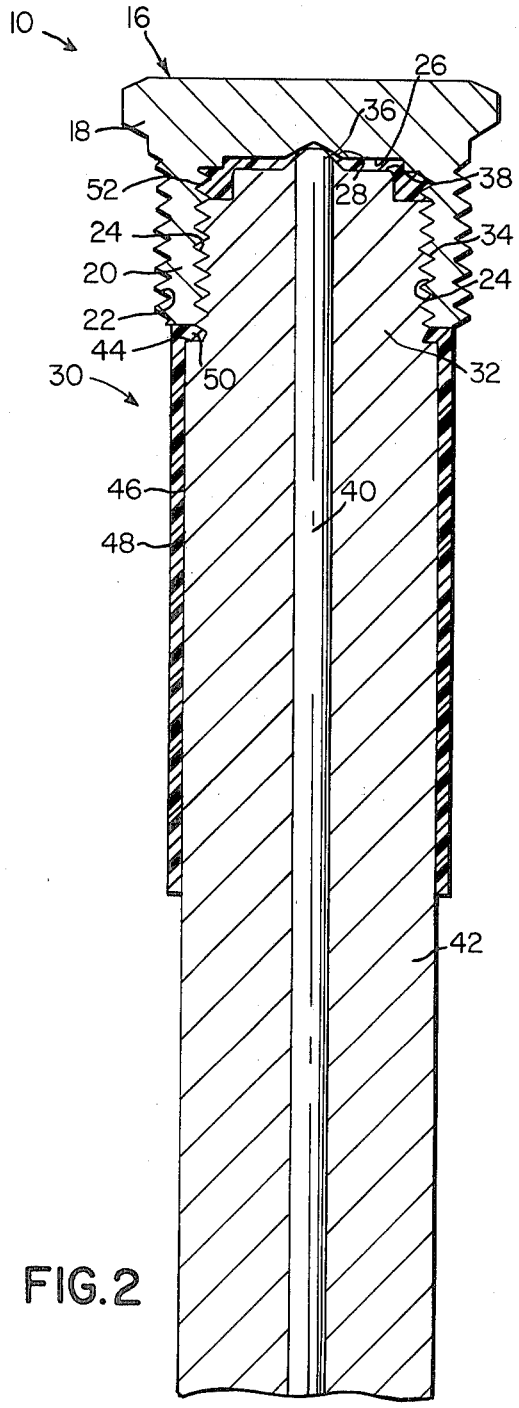
FIG.2

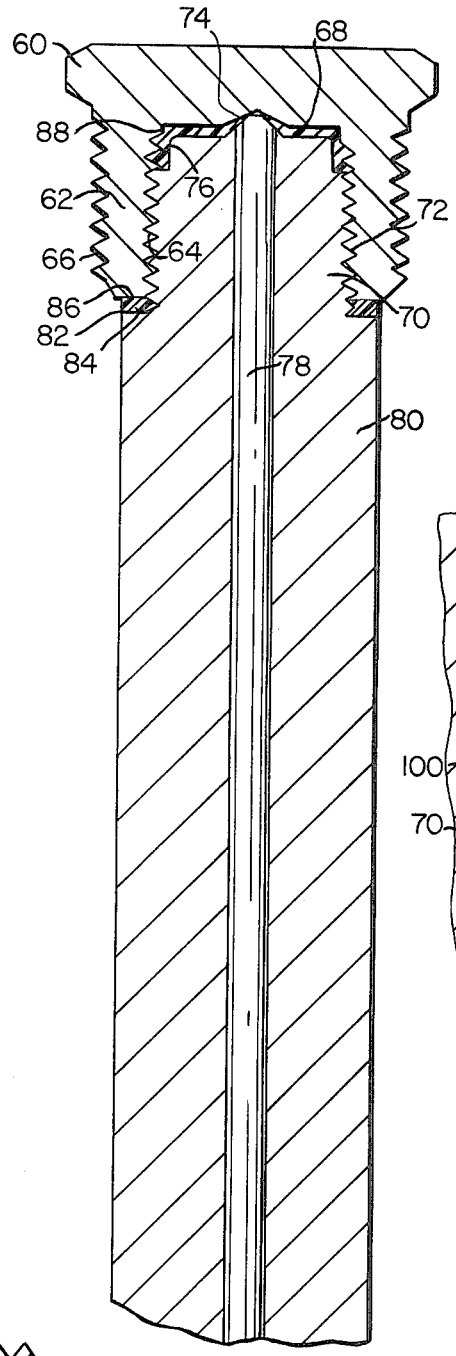
FIG. 3
FIG. 4
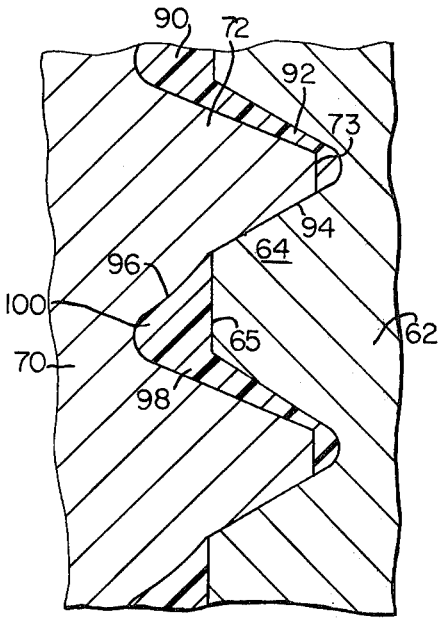
FIG. 5
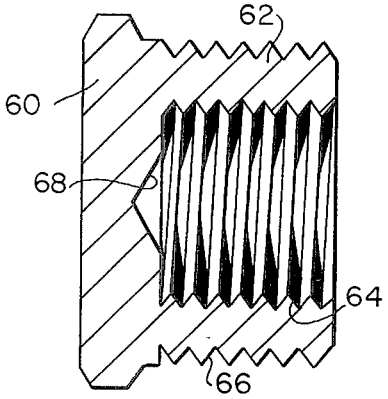
FIG. 6
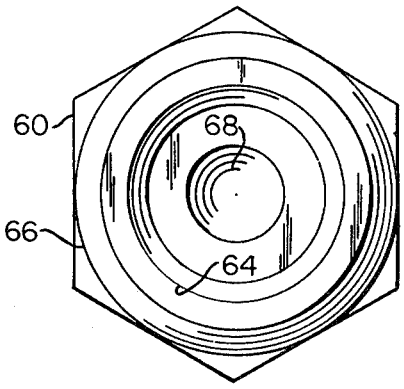

ANODE ASSEMBLY FOR HOT WATER HEATERS

BACKGROUND OF THE INVENTION

This invention relates to plug-type anode assemblies for hot water heaters which have a cap-shaped externally threaded hollow plug into which a magnesium anode is fitted.

Plug-type anode assemblies have been in use for many years and have provided a simple serviceable unit for water heaters. However, with the efforts to extend the life of hot water heaters, the previously used plug-type anodes have not been adequate. There is a need to prolong the service life of these assemblies as well as to reduce their cost of manufacture. This problem has been recognized, and several solutions have been put forth. One of the more recent revisions proposed for plug-type anode assembly units is illustrated by the Stroback et al U.S. Pat. No. 3,558,463.

These efforts, for one reason or another, have provided neither the required increased life anode assembly, nor improved performance characteristics.

SUMMARY AND FEATURES OF INVENTION

Accordingly, it is a principal feature of this invention to provide a plug-type anode assembly which has substantially increased service life.

It is another feature of this invention to provide an anode assembly which has substantially less production costs.

It is a still further feature of this invention to provide an anode assembly which has improved core wire contact between the plug and anode.

It is a still further feature of this invention to provide a plug type assembly which has substantially greater sealing characteristics than previous plug type anode assemblies.

It is a still further feature of this invention to provide a plug-type anode assembly which has both dramatically increased service life, and is readily assembled.

These and further features and advantages of the invention will become apparent from the following description of the invention.

DESCRIPTION OF THE DRAWINGS

FIG. 1 is a side view of an anode assembly in position as supported on the top plate of a water heater.

FIG. 2 is a cross-sectional view of the plug-type anode assembly of FIG. 1.

FIG. 3 is a cross-sectional view of a second modification of the anode assembly.

FIG. 4 is an enlarged sectional view of the engaged threaded surfaces of the plug and the anode.

FIG. 5 is an enlarged sectional view of the plug of FIGS. 2 and 3.

FIG. 6 is an end internal view of the plug of FIG. 5.

DESCRIPTION OF THE INVENTION

Referring to the drawings, FIG. 1 shows a plug-type anode assembly generally indicated at 10 which is mounted in the top wall 12 of a hot water heater, engaging and being supported thereon by the threaded annular opening 14 of the heater top wall 12.

As illustrated in FIGS. 1 and 2, the plug-type anode assembly includes a plug, generally indicated at 16, which has a head 18 and a depending cylindrical section 20 having external threads 22 and internal threads 24.

The plug 16 has an internal cylindrical surface 26 which has a central conical recess 28.

The anode generally indicated at 30 is an elongated magnesium rod having an upper section 32 with external threads 34. These threads engage the threads 24 of the depending section 20 of plug 16. The upper section 32 of the anode has a conical-shaped upwardly extending nose 36 at its end which projects upwardly and into the conical recess 28 in the surface 26 of the interior of the plug head 18.

A flat circular shoulder section 38 is disposed adjacent the base of the upwardly extending conical nose 36, and when the pieces are assembled, is slightly spaced from the flat interior surface 26 of the cap.

The central conducting core wire 40 of either copper or other conductor extends longitudinally down through the anode upper section 32 and through the central anode section 42. The anode itself is an elongated cylindrical piece of magnesium which extends substantially the length of the water heater within which it is placed.

The core wire provides electrical continuity between the plug and water tank and the magnesium anode. It also functions to hold the several parts of the anode together in cases where there is severe erosion and necking of the magnesium anode.

Accordingly, it is essential that there be good electical continuity between the core wire and the plug. The conical nose projection 36 of the anode is cut to expose the tip of the core wire 40 to give a large contact area for the core wire end.

The upper section 32 of the anode also has a shoulder section 44 disposed immediately below the threaded area 24. It assists in providing a seal area immediately below the depending cylindrical section 20 of the plug 16.

It has been found that an area particularly susceptible to necking of the anode occurs on the anode along the exterior peripheral surface 46 immediately below and in proximity to the depending section 20 of the plug. This is caused by increased erosion of the magnesium in this area because of the dissimilarity of the metals of the plug and the anode.

To preclude this, it has been customary to cover such area with a plastic or similar type of non-metallic material. FIGS. 1 and 2 show a special cylindrical plastic sleeve 48 which provides this type of covering. The construction shown is different from prior art devices in that the covering is a prefabricated tubing piece of heat-shrinkable plastic. It is placed over the anode upper section during assembly to cover the anode area 46 and has a small upper section 50 which extends around the shoulder 44 after the tubing has been fitted on the anode.

The material is a polyolefin composition which is extruded tubing and will shrink to a predetermined diameter upon application of heat. It is made from an irradiated thermally stabilized, modified polyolefin composition and is acceptable for use with potable water supplies. After the tubing has been fitted over the end of the anode, it is subjected to heat which shrink fits it to bring its inner surface into very tight engagement with the exterior surface 46 of the anode, providing an excellent seal through which water cannot seep. Also, the upper portion 40, on shrinking, bends around the shoulder 44 to form the continuous sealing gasket member disposed around the circular peripheral shoulder 44.

When the anode is inserted within the plug, the lowermost surface of the plug threaded section 20 presses the sealing portion 50 down into tight engagement with the shoulder thereby providing a fluid-tight seal.

In this regard, a fluid-tight seal is provided between the upper section 32 of the anode and the interior of the cap by applying a viscous expoxy sealant to the anode and plug interior. When the plug and anode are assembled, this sealant is forced into and fills the interstices and open spaces between the two members, precluding the possibility of any voids within which moisture might accumulate. The cured epoxy between the top of the anode and the cap is shown at 52 in FIG. 2.

FIG. 3 discloses another plug-type anode assembly in which the long cylindrical sleeve is omitted on the anode, and a washer type of seal used. In this embodiment, the plug has a top 60 and a depending section 62 with internal and external threads 64 and 66, respectively. The plug top internal surface has a conical depression 68.

The upper section 70 of the anode is reduced in diameter and has an external thread 72 which engages the threads 64 of the plug depending section 62. The upper end of the section 70 has an outwardly projecting conical section 74 which is centrally disposed and fits into the conical depression 68. The circular shoulder is disposed adjacent the base of the conical projection 74 and is slightly spaced from the opposed surfaces of the internal opposed surfaces of the cap.

The core wire 78 extends longitudinally through the magnesium anode central section 80 and upward through the upper anode section 70 to engage the internal cap surface of the depression 68. Immediately below the upper anode section 70 there is a shoulder 82 within which a sealing washer is disposed. This washer is annular in configuration and is pressed between the opposed surfaces 84 and 86 of the anode and plug, respectively. Dimensions of the upper anode section 70, and the spacing of the shoulder surface 84 are chosen such that when the upper conical surface 74 containing the upper tip of the core wire 78 is firmly engaged in the depression 68, the lower surface 86 of the depending plug section 62 firmly engages and squeezes the washer 82 to provide a tight seal and flow of material on the inner circular periphery into the lowermost threaded piece.

It is also important to completely exclude penetration of water through the threaded area to the interior portion of the plug, and also to provide good electrical contact between the anode and the plug itself.

FIG. 4 is an enlarged view of the threaded section on the right side of FIG. 3 showing the manner of engagement of the pipe thread 64 of plug 62 with the tapered thread 72 of the anode 70. It will be noted that when the threads are in engagement, pipe thread 64 cuts into the undersurface of the anode tapered thread 72 at 65 when the nose 74 comes into engagement with the inside surface of the cap, leaving a spiral annular passageway. The sealant completely fills the passageway above the thread 72 at 90 and at 92. There is line contact between the lower surface of the thread 72 and the thread 64 in which the steel thread 64 bites into and presses upwardly against the thread 72 in good line contact as indicated at 94. The original contour of the underside of the tapered thread 72 is indicated at 96. The sealant also flows through and fills the corresponding apex areas adjacent the end 65 of thread 64 as indicated at 98 and 100.

FIGS. 5 and 6 show the plug structure in further detail. The simple modification of the standard type plug to accommodate the nose of the anode is accomplished by slightly drilling into the interior surface of the plug head 18 to provide the conical shaped depression 68.

OPERATION

The anode assemblies are ordinarily installed on the water heater after it has been finally assembled. The anode of the assembly is inserted through the opening in the heater top wall with the plug threads engaging those of the top wall opening. The anode assembly is usually installed with a torque wrench. The assembly operation requires only a few seconds. The entire anode assembly is spun at high speed by the wrench and is abruptly stopped when the cap head comes into locking contact with the top wall of the heater. This abrupt stopping motion imparts a considerable strain on the two-piece anode assembly, and in some instances may cause hairline cracks or openings between the plug and anode pieces.

This condition can also arise during the handling of the heaters after assembly. The anode is suspended in the tank parallel to the tank's longitudinal axis. During handling and storage, the tanks are often laid on their side, so that the entire weight of the anode imparts a large bending moment at the plug which can cause a crack between anode and plug surfaces where this moment is concentrated.

If a hairline crack or opening is created, subsequent exposure to water will allow penetration and seepage of moisture along the crack line with progressive rusting and erosion. In some instances, moisture may find its way, during the course of time, all the way up along the threads to the contact area between the core wire and the cap, where oxidation will interfere with grounding of the anode core wire, impairing anode performance characteristics, and reducing life of the anode assembly.

The assembly life is dramatically enhanced by several factors, including improved rigidity of the assembly, greater core wire contact with the plug, and substantially improved impermeability of the assembly to corrosive water exposure.

Greater rigidity of the plug-anode assembly structure is provided by the use of an accurately fitted interengagement of the parts, and use of a resin cureable sealant which fills all of the interstices between the plug and the anode, making the assembly a tight unitary piece.

Core wire contact with the plug is substantially improved by the use of the reduced nose configuration at the top of the anode, most of which is exposed core wire material. The nose configuration provides a much greater contact area surface between the anode and plug than previously possible, and, in addition, provides a simple compensating arrangement for those instances in which the core wire is not completely centered. This wandering of the core wire off center within the anode is common since the anode is extruded around the core wire. When there is displacement of the core wire from the center of the anode in previous assemblies, there is a substantial reduction of the direct area of contact between the core wire and plug. With the nose configuration of this invention, the shift of the core wire from the center of the anode will merely move it from one side of the nose toward the other with no substantial reduction of contact area between core wire and plug.

The threaded engagement between anode and plug also provides a very good contact electrically due to the tight cutting fit between the ordinary pipe thread cut of the plug and the softer tapered thread of the anode, as can be seen in FIG. 4. The pipe threads bite into the softer metal threads of the anode and engage them in tight cutting line contact providing good continuity. However, it will be noted that the small open spiral passage will extend between the threads the length of the mutually threaded area. The use of the resin sealant to fill the open spiral passageway provides both rigidity and sealing of this area against water penetration.

With respect to the sealing against water penetration, it should be noted that the seal on the anode shoulder provides a tight forceful interfitting arrangement between the two opposed metal surfaces. The plastic material provides a firm unyielding and dimensionally stable sealing washer capable of sustaining a very strong force, thereby providing a tight locking seal impenetrable to water seepage.

A further approach to improving the sealing characteristics and protecting the top of the anode against erosion is provided by the use of the tubular sleeve of FIGS. 1 and 2, the sleeve being made of a heat-shrinkable composition which shrinks to about half of its original diameter, thereby causing a very high pressure gripping engagement with the anode outer surface, with continual pressure exerted uniformly around the anode upper surface. This tight forceful fit absolutely precludes any water seepage up along the anode surface under the sleeve.

In addition, the foldover action of the upper section of the tubular shrinkable sleeve piece permits it to be used as a washer between the shoulder of the anode and the plug, providing a continuous sealed piece which envelops the shoulder of the anode. The very large shrinkage characteristics of the tubular sleeve brings about the foldover of the upper edge. Shrinkage of the upper edge is great enough to pull it in toward the center of the anode in a uniform foldover configuration, so that the plug depending section can readily close down on it without any additional holding during the assembly operation.

The tubing used for the sleeve is supplied as an expanded piece of tubing which recovers dimension after heating. It initially has a one inch inside diameter which when shrinking will reduce to slightly less than one-half inch diameter. It will have a wall thickness of approximately thirty-five thousandths of an inch. The anode size is approximately three-quaters of an inch, so that there is great pressure exerted by the tubing as it attempts to return to its original dimension. The tensile strength rating of the tubing is a minimum of approximately fifteen hundred pounds per square inch. The material also has good electrical characteristics, having a dielectric strength of five hundred volts minimum per mil. The tubing is flexible and extruded from an irradiated, thermally stabilized, modified polyolefin composition which is homogenous and free from flaws, pinholes, cracks or inclusions, and is approved for contact with potable water supplies. It is non-corrosive and fungus resistant, as well as having a very low water absorption coefficient of 0.2% in twenty-four hours at 77° F. The sealant has a general viscosity approaching that of a light syrup and is in the neighborhood of fifty thousand centipoises. About one-third of a thimble is applied to the three-quarter inch diameter anode or cap, preferably along the thread prior to threadedly engaging the plug and anode top. When pieces are threaded together, usually by a torque wrench, the sealant is driven along the spiral passage between the threads, completely filling the voids. This is ensured by applying a measured amount of fluid which experience has shown will be sufficient to fill the interstices. Resi-Weld resin has been very effectively used in this regard.

While this invention has been described, it will be understood that it is capable of further modification, uses and/or adaptations of the invention following in general the principle of the invention and including such departures from the present disclosure as come within known or customary practice in the art to which the invention pertains, and as may be applied to the essential features hereinbefore set forth, as fall within the scope of the invention or the limits of the appended claims.

What I claim is:

1. An anode assembly for hot water heaters, comprising:
   (a) a cap-shaped plug having a central substantially flat section, and an externally and internally threaded depending cylindrical section,
   (b) an elongated anode made of magnesium and having a central longitudinally extending core wire,
   (c) the anode having a threaded upper section dimensioned to fit within and threadedly engage the internal threads of the depending cylindrical section of the plug,
   (d) the top surface of the anode and the internal surface of the flat section of the plug each having one of two centrally disposed shaped, mutually engageable portions which are pressed into firm interengagement to provide good mechanical interlock and good electrical continuity,
   (e) the lower surface of the threads of the plug and the upper surface of the threads of the anode being drawn into firm direct contact with each other while creating a spiral cavity between the other adjacent teeth surfaces, and
   (f) thermosetting low viscosity sealant disposed within the spiral cavity and completely filling it to provide a solid continuous watertight area.

2. The anode assembly for hot water heaters as set forth in claim 1, wherein:
   (a) the top surface of the anode includes a central upwardly truncated projection containing the top portion of the core wire, and
   (b) the internal surface of the flat section of the cap includes an inclined wall cavity in alignment with the projection on the anode and into which the projection is received.

3. The anode assembly for hot water heaters as set forth in claim 2, wherein:
   (a) there is initial peripheral contact between the circular top periphery of the truncated projection and the cavity surface with longitudinal clearance between the other surfaces sufficient to provide for slight misalignment correction and flow of the metal on seating of the anode within the plug whereby good electrical continuity is obtained between the core wire and the inclined wall of the cavity.

4. The anode assembly for hot water heaters as set forth in claim 1, wherein:
   (a) the sealant is a heat curable plastic having a viscosity at room temperature of approximately fifty thousand centipoises.

5. The anode assembly for hot water heaters as set forth in claim 1, wherein:

(a) a shoulder is provided on the anode immediately below the threaded upper section and dimensioned to be slightly spaced from the opposed bottom surface of the plug cylindrical section so as to provide an annular space for receiving a sealing member, and (b) a sealing member is disposed on the anode and within the annular space compressed between the opposed flat and bottom surfaces when the anode is seated within the plug.

6. The anode assembly for hot water heaters as set forth in claim 5, wherein:

(a) a continuous heat shrinkable tubular member of plastic material is disposed on the anode immediately below the shoulder in watertight engagement with the periphery of the anode.

7. The anode assembly for hot water heaters as set forth in claim 6, wherein:

(a) the tubular member and the sealing member are integral with each other and form a continuous piece which covers the shoulder.

8. An anode assembly for hot water heaters, comprising:

(a) a cap-shaped plug having a central substantially flat section and an externally threaded depending cylindrical section, (b) an elongated anode of magnesium of substantially the same diameter as the plug and having an upper section dimensioned to fit within and engage the cylindrical section of the plug, and (c) a preformed heat shrinkable cylindrical protective sealing sleeve disposed on the anode in tight tensile watertight sealing engagement with the periphery thereof immediately below the section of the anode, such sleeve initially having a normal internal diameter greater than the diameter of the anode and which on heating tends to shrink to a diameter substantially less than the diameter of the anode but is precluded from doing so by the anode surface resulting on shrinkage in a tightly stressed watertight engagement between the anode and inner surface of the sleeve.

9. An anode assembly for hot water heaters, comprising:

(a) a cap-shaped plug having a central substantially flat section and an externally and internally threaded depending cylindrical section, (b) an elongated anode of magnesium of substantially the same diameter as the plug and having a threaded upper section dimensioned to fit within and threadedly engage the internal threads of the cylindrical section of the plug, (c) a heat shrinkable cylindrical protective sealing sleeve disposed on the anode in tight tensile watertight sealing engagement with the periphery thereof immediately below the threaded section of the anode, (d) a shoulder is provided on the anode immediately below the threaded section, and (e) the upper portion of the sealing sleeve extends around the shoulder and under and in contact with the lower annular surface of the depending section of the plug.

10. The anode assembly for hot water heaters as set forth in claims 8 or 9, wherein:

(a) the sealing sleeve is a continuous tubing member of thermally stabilized modified polyolefin composition.

11. The anode assembly for hot water heaters as set forth in claims 8 or 9, wherein:

(a) the tubing is approximately one thirty-second of an inch thick.

12. The anode assembly for hot water heaters as set forth in claims 8 or 9, wherein:

(a) the composition of the sealing sleeve has insulative strength of approximately 500 volts per mil, and (b) a tensile strength greater than one thousand psi.

13. The anode assembly for hot water heaters as set forth in claims 8 or 9, wherein:

(a) the modified polyolefin composition is fungus resistant, and (b) its water absorption coefficient for a twenty-four hour period at 77° F. is a maximum of 0.2.

14. An anode assembly for hot water heaters, comprising:

(a) a cap-shaped plug having a central substantially flat section and an externally and internally threaded depending cylindrical section, (b) an elongated anode of magnesium of substantially the same diameter as the plug and having a threaded upper section dimensioned to fit within and threadedly engage the internal threads of the cylindrical section of the plug, (c) a heat shrinkable cylindrical protective sealing sleeve of thermally stabilized modified polyolefin composition disposed on the anode in tight tensile watertight sealing engagement with the periphery thereof immediately below the threaded section of the anode, (d) a shoulder disposed on the anode immediately below the upper threaded section, (e) the upper portion of the sealing sleeve extends around the shoulder and under and in contact with the lower annular surface of the depending section of the plug, (f) the top surface of the anode and the internal surface of the flat section of the plug each having one of two centrally disposed shaped mutually engageable portions which are pressed into firm interengagement to provide good mechanical interlock and good electrical continuity, and (g) the lower surface of the threads of the cap and the upper surface of the threads of the anode being drawn into firm direct contact with each other while creating a spiral cavity between the other adjacent teeth surfaces, and (h) thermosetting low viscosity sealant disposed within the spiral cavity and completely filling it to provide a solid continuous watertight area.

15. The anode assembly for hot water heaters as set forth in claim 14, wherein:

(a) the top surface of the anode includes a central upwardly truncated projection containing the top portion of the core wire, and (b) the internal surface of the flat section of the cap includes an inclined wall cavity in alignment with the projection on the anode and into which the projection is received.

16. The anode assembly for hot water heaters as set forth in claim 15, wherein:

(a) the sealing sleeve has an insulative strength of approximately 500 volts per mil and a tensile strength greater than one thousand psi.

17. An anode assembly for hot water heaters, comprising:

(a) a cap-shaped plug having a central substantially flat section and an externally and internally threaded depending cylindrical section, (b) an elongated anode of magnesium of substantially the same diameter as the plug and having a threaded upper section dimensioned to fit within and threadedly engage the internal threads of the cylindrical section of the plug, (c) a shoulder on the anode immediately below the upper threaded section, (d) a prefabricated heat shrinkable cylindrical protective sealing sleeve slidably assembled over the anode immediately below the threaded section of the anode which has an initial diameter greater than that of the anode and is disposed to shrink on application of heat to a diameter substantially less than that of the anode so that on application of heat its inner surface shrinks to a stressed watertight sealing engagement against the anode surface, (e) the sealing sleeve is fungus resistant, has a very low water absorption coefficient, and has an insulative strength os approximately 500 volts per mil, and (f) the upper portion of the sleeve extends above the shoulder to act as a seal for precluding water seepage between the adjacent surfaces of the shoulder and threaded depending section of the plug.

* * * * *